US005098328A

United States Patent [19]

Beerens

[11] Patent Number: 5,098,328

[45] Date of Patent: Mar. 24, 1992

[54] BUILDING BLOCKS WITH SIX FACE SYMMETRY

[76] Inventor: Cornelis Beerens, 42 Berkshire Road, Victoria, 3020, Australia

[21] Appl. No.: 467,975

[22] Filed: Jan. 22, 1990

[30] Foreign Application Priority Data

Jan. 20, 1989 [AU] Australia ..... PJ2357

[51] Int. Cl.[5] ..... A63H 33/08; C04C 3/00

[52] U.S. Cl. ..... 446/128; 446/125; 52/594

[58] Field of Search ..... 446/188, 126, 125, 124, 446/121, 120, 85, 487, 488; 52/593, 594, 595, 596, 603, 609; 405/284, 286, 287

[56] References Cited

U.S. PATENT DOCUMENTS 903,907 11/1908 Soss ..... 52/594
3,670,449 6/1972 Lemkin et al. ..... 446/126 X

FOREIGN PATENT DOCUMENTS 0121433 10/1984 European Pat. Off. ..... 446/124
478967 1/1916 France ..... 52/594
2274329 1/1976 France ..... 446/124
462453 3/1951 Italy ..... 52/594
15956 of 1914 United Kingdom ..... 52/594
1212537 11/1970 United Kingdom ..... 446/125

*Primary Examiner*—David N. Muir
*Attorney, Agent, or Firm*—Scully, Scott, Murphy & Presser

[57] ABSTRACT

Building blocks for use as toys which have six identical faces and interlock by 1, 2 or 4 quarters of each face, On each of the six faces of the building block there are provided four quartered sections, two of which are projecting with respect to the broadest plane of the face and two of which are recessed with respect to the same plane. Each of the projecting quarters of each face have a hole of a predetermined dimension in the center thereof; and each of the recessed quarters have a peg extending therefrom. The blocks may be connected as above mentioned by either 1, 2 or 4 quarters of each face with the complementary quarters of a second block. An unlimited number of blocks may be connected to form complete structures as desired.

14 Claims, 2 Drawing Sheets

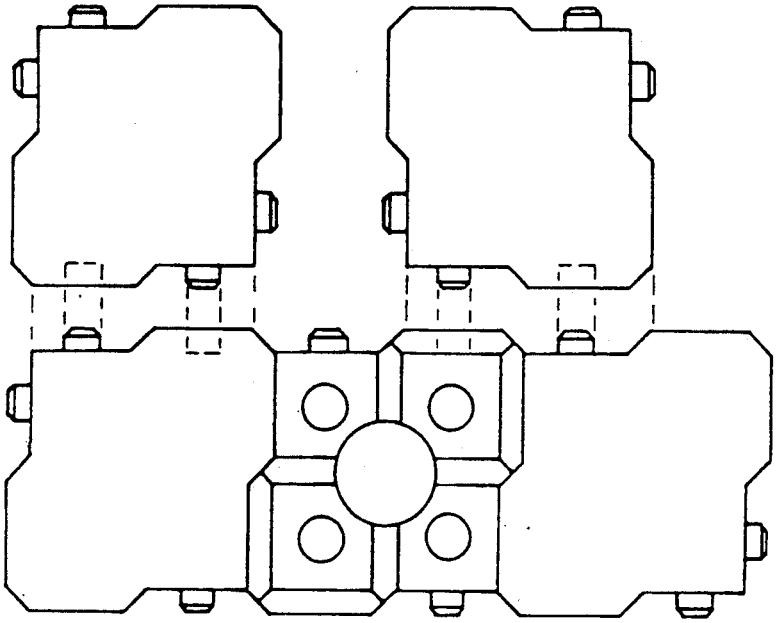
FIG 3
FIG 4
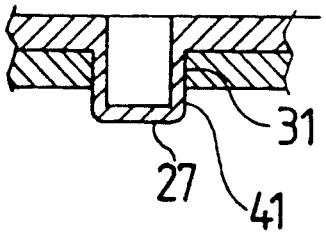

BUILDING BLOCKS WITH SIX FACE SYMMETRY

FIELD OF THE INVENTION

This invention relates to building blocks.

Many toy building blocks are known but most are limited in the manner in which they can be put together.

The present invention seeks to provide a building block which can be assembled with other such building blocks in a number of orientations.

SUMMARY OF THE INVENTION

The present invention provides a building block (hereinafter called "the first block") of cuboid shape having 6 faces adapted to allow any of its faces to interlock together with any of the faces of another identical block. (hereinafter called "a second block")

The present invention also provides a building block (hereinafter called "the first block") of cuboid shape having 6 faces and wherein each face has a first interlocking means in two diagonally opposite quarters thereof and a second interlocking means in the other two diagonally opposite quarters thereof and wherein another such block (hereinafter called "the second block") can be interlocked to any one of the faces of the first block selectively:

in a first orientation in which one of the faces of the second block fully overlies one of the faces of the first block with the first and second interlocking means of the face interlocked with the second and first interlocking means of the other face, in a second orientation in which half of one of the faces of the second block having one of the first interlocking means and one of the second interlocking means overlies half of one of the faces of the first block having one of the second interlocking means and one of the first interlocking means with the first interlocking means of the halves of the faces interlocked with the second locking means of the halves of the faces, and in a third orientation in which one of the quarters of one of the faces of the second block having one of the first or second interlocking means overlies one of the quarters of the first block having one of the second or first locking means with the first locking means interlocked with the second locking means.

The present invention also provides a building block (hereinafter called "the first block") of cuboid shape having 6 identical faces and wherein each face has a relatively projecting portion in two diagonally opposite quarters thereof and a relatively recessed portion in the other two diagonally opposite quarters thereof and wherein another such block (hereinafter called "the second block") can be fitted to any one of the faces of the first block in a first orientation in which one of the faces of the second block fully overlies one of the faces of the second block with the projecting portions of the face located in the recessed portions of the other face, in a second orientation in which half of one of the faces of the second block having one of the projecting portions and one of the recessed portions overlies half of one of the faces of the first block having one of the recessed portions and one of the projecting portions with the projecting portions of the halves of the faces located in the recessed portions of the halves of the faces and a third orientation in which one quarter of one of the faces of the second block having one of the projecting portions or one of the recessed portions overlies one quarter of the first block having one of the recessed portions or one of the projecting portions with the projecting portion located in the recessed portion.

Preferably there is an aperture centrally located in each of the faces.

Preferably there is a hole in each of the projecting portions and a peg member on each of the recessed portions, the holes and the peg members being sized and located such that the respective peg member or members may enter the respective hole in each of the above described orientations.

Preferably the peg members are shaped to be a tight fit in the holes.

Preferably the peg members project from the recessed portions to the same height as the projecting portions so that the block will sit flat.

Preferably the peg members have a length greater than the depth of the holes whereby the entering end of the peg members will project within the building block beyond the depth of the respective hole. If the peg member is made sufficiently large or if the holes taperingly narrows from the end which the peg members are to enter, compression of the peg members may occur when they are inserted into the hole and that portion which projects within the building block beyond the depth of the building block may resile to improve the integrity of the resultant connection.

The holes into which the peg members fit may be noncircular.

The orientation of the projecting portions and recessed portions on the faces is preferably such that the faces of the building block which are adjacent at each edge of the building blocks are mirror images of one another.

The building block is preferably comprised of 6 identical plates which interfit to form the building block with one side of each of the plates constituting one face of the building block.

The 6 plates which interfit have said one side and an opposite side and preferably there is a flange or projections projecting from the opposite side at each of two opposite edges, an abutment on the opposite side adjacent each of the other two edges, a projection or a recess on or in each of the flanges or projections and a recess or a projection in or on the opposite side adjacent said each of the other two edges; the arrangement being such that the plates may snap-fittingly engage with one another to form the building block.

Preferably the projection comprises a ramp surface to facilitate such snap-fitting engagement.

Preferably each face of the building block presents one of three colours and the colours are arranged such that when in said first and third orientations an assemblage of such blocks will present a single colour on each side of the assemblage.

Edges of the building block, apices of the building block, edges and holes and edges of the projecting portions and recessed portions may be chamfered if desired.

In another aspect the present invention provides a plate for forming a building block or a cuboid structure, the plate having the form described above.

A specific construction of a plate and a building block in accordance with this invention will now be described with the aid of the accompanying drawings in which:

BRIEF DESCRIPTION OF THE DRAWINGS

FIG. 3 is a schematic drawing illustrating ways of assembling building blocks, FIG. 4 is a cross-sectional view of parts of two building blocks when in interengagement, The building block 1 shown in FIG. 1 is cuboid and has 6 identical faces.

Figure 1:
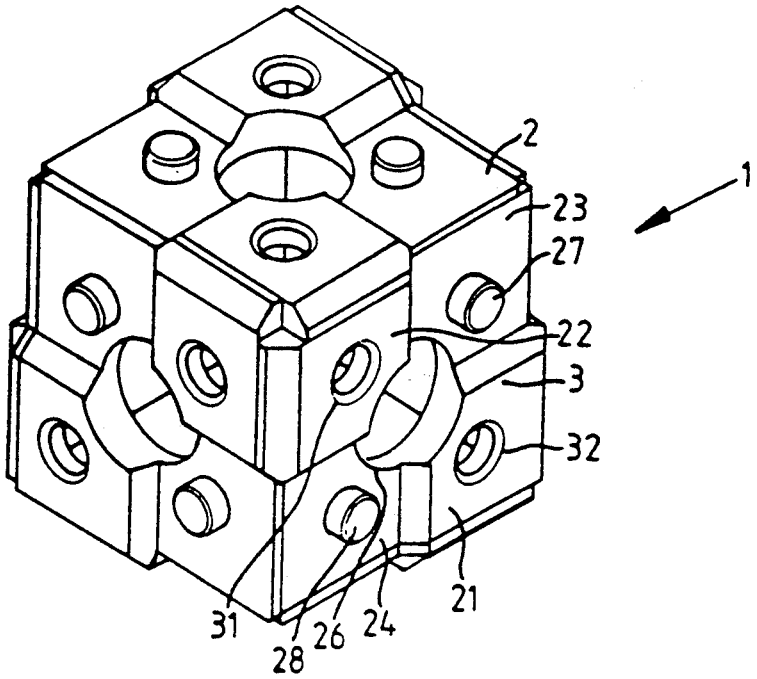
FIG. 1 is a perspective view of the building block.

The building block 1 is formed from 6 identical plates 2.

DETAILED DESCRIPTION OF THE PREFERRED EMBODIMENTS

Each of the plates 2 has a face 3 which defines, in use, one of the faces of the block 1 and an opposite side 4.

On the face 3 of each plate 2 is diagonally opposite quarters are projecting portions 21 and 22 and in the other diagonally opposite quarters there are recessed portions 23 and 24.

A central aperture 26 is located in the face 3. That aperture 26 removes a major area of potential weakness. Further, the aperture 26 may be used to receive objects such as string, a pencil or a flower.

Located on the recessed portions 23 and 24 are projections 27 and 28. Located in the projecting portions 21 and 22 are recesses 31 and 32. The projections 27 and 28 and the recesses 31 and 32 are chamfered as shown. The projections 27 and 28 are the same height as projections 21 and 22 so that the block can sit flat and can be put on another block in non-interlocking relation of desired.

On the opposite side 4 of each plate 2 are two upstanding flanges 33 and 34 which are at opposite edges. Also on the opposite side 4 are abutments 36 and 37. Recesses 38 and 39 are also provided in the opposite side 4. The flanges 33 and 34 are the same width as the gap between the flanges to stop parts from sliding.

Ramplike projections 41 and 42 are located on the flanges 33 and 34.

Figure 2:
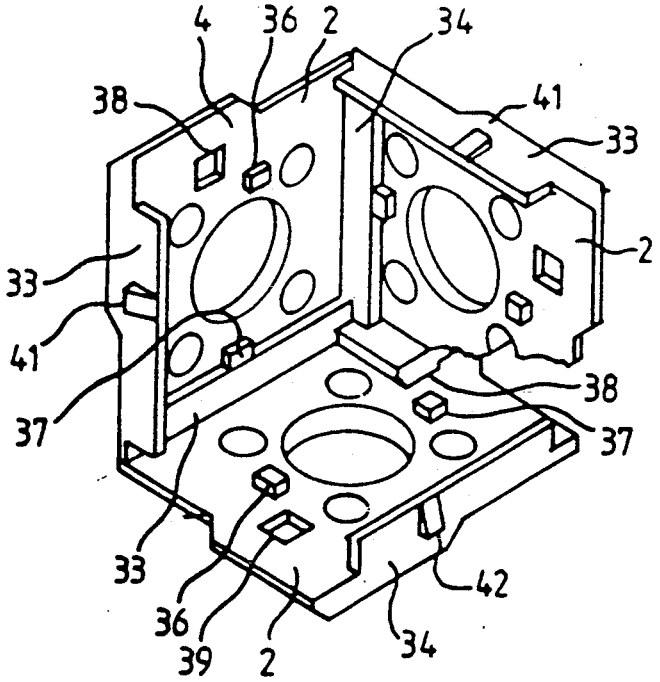
FIG. 2 is a perspective view of part of the building block showing plates from which the building block is formed.

The plates 2 are assembled together as is best seen in FIG. 2 and in particular it is to be noted that the ramplike projections 41 and 42 are received in the recesses 38 and 39 and the flanges 33 and 34 abut against the abutments 36 and 37.

When all 6 plates are assembled to one another the building block so formed is strong.

It is particularly desirable that the plates 2 are coloured and that 3 colours are used with opposite plates on opposite sides of the cuboid being of the same colour. This arrangement permits various attractive colour possibilities in assembly. Such colour will also aid assembly.

The form of the above described building block enables it to be assembled with other such blocks in a number of ways.

As shown in FIG. 3, blocks may be in a first orientation which is a full face orientation, a half face orientation or a quarter face orientation (not shown in FIG. 3). Blocks may be added on all sides of any one block to build such a structure as is desired.

By joining blocks in the aforesaid first and third orientations, the colours presented to an observer looking in a particular direction will be the same if joined faces are of the same colour. The use of colours can aid assembly of blocks in the aforesaid first and third orientations.

It is to be noted that the projections 27 and 27 are sized to be compressed on entering the recesses 31 and 32 so that with time they will resile at 41 to improve locking.

The plates 2 can be easily formed by injection moulding using a tool which splits at only one level.

The plates 2 have no undercuts so as to make for easy tooling.

The described arrangement has been advanced merely by way of explanation and many modifications may be made thereto without departing from the spirit and scope of the invention which includes every novel feature and combination of novel features herein disclosed.

I claim:

1. A building block of cuboid shape having six faces wherein each said face has two diagonally opposed projecting portions and two diagonally opposed recessed portions forming a quartered square wherein each of the projecting portions incorporate a hole of specified dimension at the respective centers thereof and each of the recessed portions include a peg member projecting from the respective centers thereof each having a dimension substantially identical to the dimension of said holes such that another said block is selectively interlockable with any part of the faces of the first block:

in a first orientation one of the faces of the second block fully overlying one of the faces of the first block with the projecting portions with holes interlocking with the recessed portions with pegs;

in a second orientation in which half of one of the faces of the second block having two quarters of the quartered square representing one half of one face interlocked with one half of the first block, and in a third orientation having one of the quarters of one of the faces of the second block interlocked with one of the quarters of the first block having a complimentary quarter.

2. A building block as claimed in claim 1, wherein each face has a projecting portion in two diagonally opposite quarters thereof and a recessed portion in the other two diagonally opposite quarters.

3. A building block as claim in claim 1, wherein a peg member on each of the recessed portions is sized and located such that the respective peg member or members enters the respective hole in a raised portion in each of said orientations.

4. A building block as claimed in claim 3, wherein the peg members are tightly fitted in the holes.

5. A building block as claimed in claim 3, wherein the peg members project from the recessed portions to the same height as the projecting portions so that the block is flatly seated.

6. A building block as claimed in claim 3, wherein the peg members have a length greater than a depth of the holes such that an entering end of the peg members project within the building block beyond the depth of the respective hole.

7. A building block as claimed in claim 1, wherein an aperture is centrally located in each of the faces.

8. A building block as claimed in claim 1, comprising six identical plates which interfit to form the building block with one side of each of the plates constituting one face of the building block.

9. A building block as claimed in claim 8, wherein said six plates which interfit have said one side and an opposite side, a flange projecting from the opposite side at each of two opposite edges, an abutment on the opposite side adjacent each of the other two edges, a projection on each of the flange and a recess in the opposite side adjacent said each of the other two edges; the arrangement being such that the plates are snap-fittingly engageable with one another to form the building block.

10. A building block as claimed in claim 9, wherein the projection comprises a ramp surface to facilitate such snap-fitting engagement.

11. A building block as claimed in claim 8, wherein said six plates which interfit have said one side and an opposite side, a flange projecting from the opposite side at each of two opposite edges, an abutment on the opposite side adjacent each of the other two edges, a recess in each of the flanges and a projection on the opposite side adjacent said each of the other two edges; the arrangement being such that the plates are snap-fittingly engageable with one another to form the building block.

12. A building block as claimed in claim 1, wherein each face of the building block presents one of three colours arranged such that upon positioning in said first and third orientations as assemblage of such blocks presents a single colour on each side of the assemblage.

13. A building block as claimed in claim 1, a plurality of plates each being constructed to interfit with other such plates to form the building block with one face of the plate constituting one face of the building block.

14. A building block as claimed in claim 13, wherein the six plates which interfit have said one side and an opposite side, and a flange or projections projecting from the opposite side at each of two opposite edges, an abutment on the opposite side adjacent each of the other two edges, a projection or a recess on or in each of the flanges or projections and a recess or a projection in or on the opposite side adjacent said each of the other two edges; the arrangement being such that the plates are snap-fittingly engageable with one another to form the building block.

* * * * *

UNITED STATES PATENT AND TRADEMARK OFFICE

CERTIFICATE OF CORRECTION

PATENT NO. : 5,098,328

DATED : March 24, 1992

INVENTOR(S) : Cornelius J. M. Beerens

It is certified that error appears in the above-identified patent and that said Letters Patent is hereby corrected as shown below:

In the Abstract, line 2: "face, On" should read as --face. On--

Column 3, line 34: "of" should read as --if--

Column 4, line 3: "and 27" should read as --and 28--

Column 5, line 6, Claim 9: "flange" should read as --flanges--

Column 6, line 4, Claim 12: "as" should read as --an--

Signed and Sealed this

Third Day of August, 1993

Michael K. Kirk

*Attest:*

MICHAEL K. KIRK

*Attesting Officer*

*Acting Commissioner of Patents and Trademarks*